United States Patent [19]

Lew

[11] 3,937,510

[45] Feb. 10, 1976

[54] COUPLED CHOPSTICKS

[76] Inventor: Hyok Sang Lew, 17776 W. 14th Ave., No. 2, Golden, Colo. 80401

[22] Filed: May 29, 1973

[21] Appl. No.: 364,878

[52] U.S. Cl. ..... 294/16; 294/99 R

[51] Int. Cl.[2] ..... A47G 21/10

[58] Field of Search ..... 294/8.5, 11, 16, 28, 33, 294/106, 99 R, 118; 24/81 TT, 137 R, 137 A, 248 SB, 255 FH, 255 TZ; 30/134, 135, 150; 81/43; 128/321, 354

[56] References Cited

UNITED STATES PATENTS

| | | | |
|---|---|---|---|
| 1,134,710 | 4/1915 | Wild | 24/137 A |
| 1,417,619 | 5/1922 | Male | 294/99 R |
| 2,334,252 | 11/1943 | Darling | 81/43 |
| 2,711,339 | 6/1955 | McGogy | 294/99 R |
| 2,757,951 | 8/1956 | Benton | 294/16 |
| 2,997,328 | 8/1961 | Lee | 294/16 |
| 3,637,248 | 1/1972 | Arita | 294/16 |

*Primary Examiner*—Evon C. Blunk
*Assistant Examiner*—Johnny D. Cherry

[57] ABSTRACT

A pair of coupled chopsticks for grasping food is disclosed. The coupling intermediate each of the chopsticks is formed by a pair of coil springs. Each of the coil springs includes arms extending therefrom, each arm of each coil spring being attached to one of the chopsticks. A clamp secures the two coil springs to each other in axial alignment. The axis of the pair of coil springs represent the point about which the chopsticks pivot. The arms of the coil springs maintain the chopsticks aligned within the same plane. Thereby, one end of the pair of chopsticks can be squeezed together to grasp food without having the pair of chopsticks become skewed.

9 Claims, 7 Drawing Figures

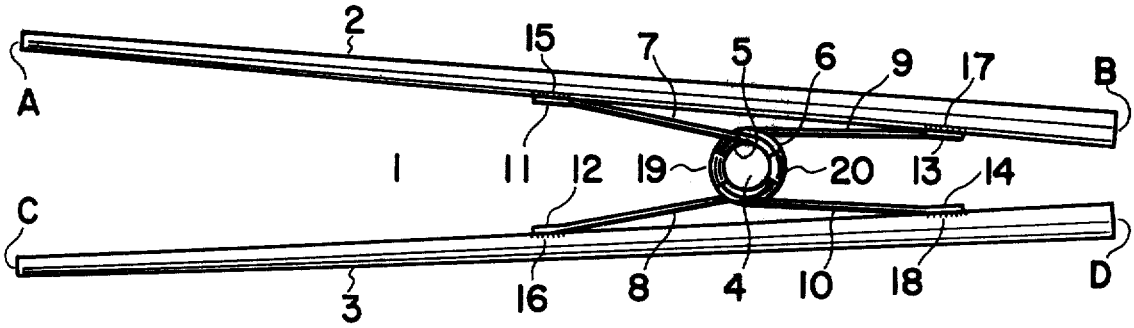
Fig. 1
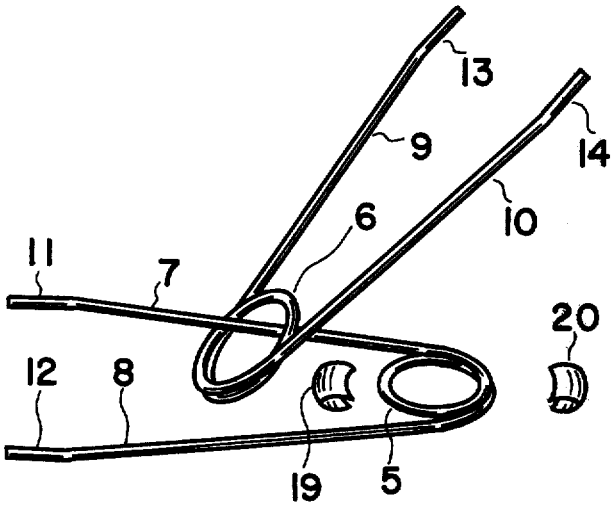
Fig. 2
Fig. 3
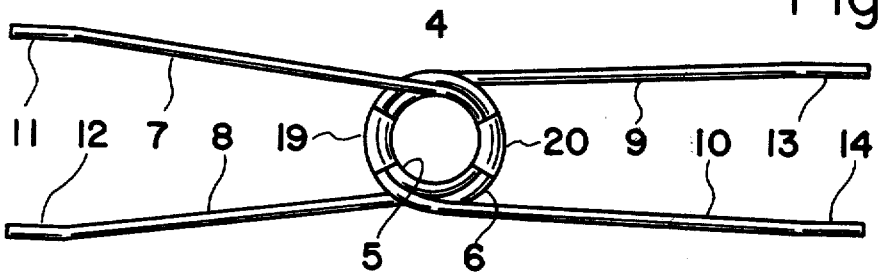
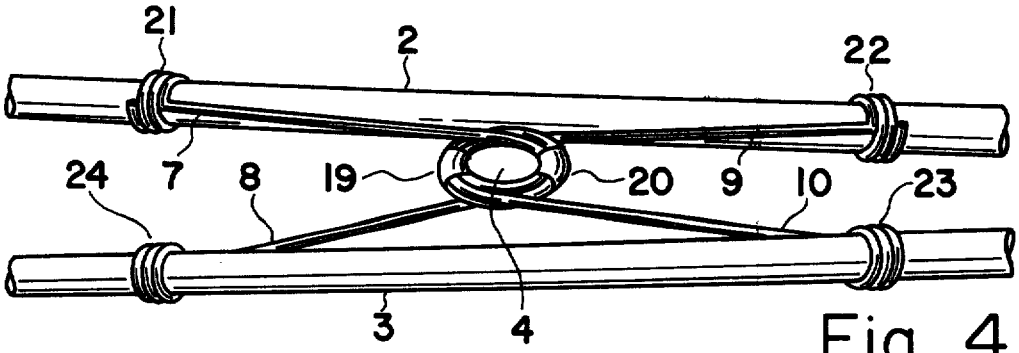
Fig. 4

COUPLED CHOPSTICKS

The present invention relates to cutlery, and more particularly, to hand manipulated eating utensils.

Eating utensils, particularly as used in the Western world, are generally confined to knives, forks, and spoons. These utensils permit a diner to cut the food and convey it to his mouth after spearing or ladling it. In the Orient, a fourth type of eating utensil, chopsticks, have been used for centuries. By correctly manipulating the chopsticks it is possible to grasp, rather than spear or ladle, the food. For some foods, particularly vegetables, the juices are not expelled with the attendant loss of flavor in conveying the vegetable to the diner's mouth. Chopsticks are also particularly well suited for grasping small pieces of meat and dipping them into a sauce before they are eaten. Where pieces of meat are deep-fried to form a crust about the piece of meat to retain the juices therein, chopsticks are particularly well suited to grasp the piece of meat without piercing the crust and permitting the fluids to flow therefrom. As a result, the diner may enjoy the full flavor of the food.

Chopsticks are usually formed of bamboo, ivory or stainless steel. Being essentially two disconnected sticks, a certain degree of skill is required to manipulate them properly. For this reason, most of the people within the Western world have never used chopsticks except on rare occasions as a lark. In order to make chopsticks more acceptable to those persons not trained from childhood to use chopsticks, several devices have been developed. U.S. Pat. No. 2,997,328 discloses a pair of chopsticks connected to one another by means of a coil spring. This device does not satisfy the objective of requiring a low skill level by the user as the chopsticks are free to pivot with respect to each other in two planes, which planes are normal to one another. Further, the chopsticks cannot be easily laterally movable with respect to one another. Because of these deficiencies, a level of skill, commensurate with that required for a plain pair of chopsticks is necessary. U.S. Pat. No. 3,186,749 teaches a pair of chopsticks resiliently attached to one another by means of a curved planar spring member. The spring member is intended to permit the chopsticks to pivot with respect to each other in a first plane and probably accommodates some lateral movement between the chopsticks. A disadvantage of this device is that the chopsticks may pivot with respect to each other in a second plane, which second plane is normal to the first plane. The restraint against pivotal movement in the second plane is a function of the structural rigidity of the single attachment point on each chopstick.

From the above discussion, it becomes apparent that of the known attempts in developing a pair of coupled chopsticks, several problem areas have not been solved. Namely, the known devices do not necessarily restrain nor inhibit pivotal movement between the two chopsticks to a single plane. In addition, lateral movement, necessary for the proper manipulation of the chopsticks, is not specifically accommodated.

It is therefore a primary object of the present invention to provide a set of coupled chopsticks.

Another object of the present invention is to provide a set of coupled chopsticks delimiting pivotal movement between the chopsticks to one plane.

Still another object of the present invention is to provide a set of coupled chopsticks adapted to accommodate lateral movement between each of the chopsticks.

Yet another object of the present invention is to provide a geometrically elegant set of coupled chopsticks.

A further object of the present invention is to provide a spring biased coupling for mated eating utensils.

A still further object of the present invention is to provide a mechanically simple coupling disposed intermediate a pair of chopsticks.

A yet further object of the present invention is to provide an inexpensive set of coupled chopsticks.

These and other objects of the present invention will become apparent to those skilled in the art as the description thereof proceeds.

The present invention may be described with greater specificity and clarity with reference to the following figures:

FIG. 1 illustrates a perspective view of the present invention.

FIG. 2 illustrates an exploded view of the coupling of the present invention.

FIG. 3 illustrates the assembled coupling of the present invention.

FIG. 4 illustrates a modification of the means for securing the chopsticks to the coupling.

Figure 5:
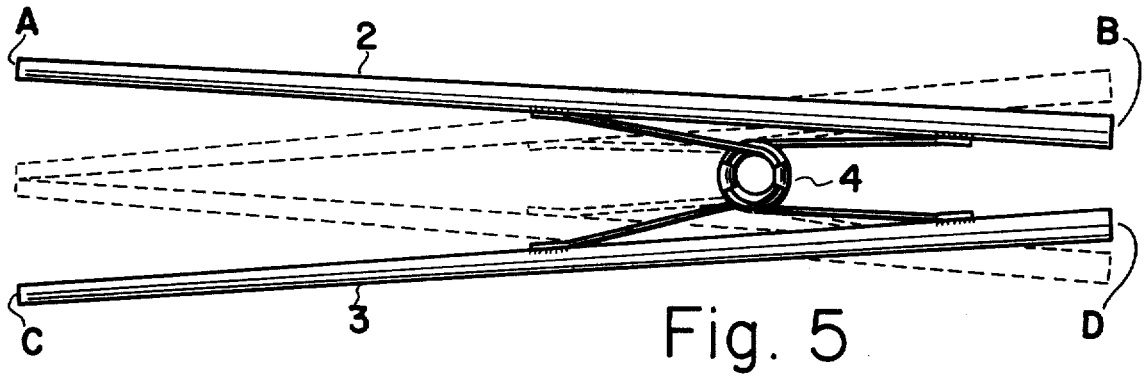
FIG. 5 illustrates the pivotal movement of the present invention.

Referring to FIG. 1, there is shown a set of coupled chopsticks 1 having chopsticks 2 and 3 connected to one another by coupling 4. Each of the chopsticks 2 and 3 may be made from bamboo, ivory, stainless steel, or other material depending upon cost factors and intended durability and strength. Further, the chopsticks may be circular in cross-section, as is normal or they may be of other cross-sectional configuration depending upon aesthetic as well as practical requirements. Usually they are tapered with ends A and C being the gripping portions and of smaller cross-sectional area than butt ends B and D. As the chopsticks are usually grasped off center and toward ends B and D, the tapering configuration aids in obtaining proper balance and hence more facile utilization of the set of chopsticks.

Coupling 4 is formed by a pair of coil springs 5 and 6 axially aligned with and secured to one another by clamps such as clamps 19 and 20. Coil spring 5 is formed with one or more coils, the ends of which extend therefrom as arms 7 and 8. Arms 7 and 8 extend from opposite sides of the coil in essentially the same direction but are not parallel to one another. Similarly, coil spring 6 is formed of one or more coils having the ends thereof extending in essentially the same direction of either side of the coil and represented by arms 9 and 10. As with arms 7 and 8, arms 9 and 10 are not parallel with one another.

Ends 11 and 12 of arms 7 and 8 are fixedly secured to chopsticks 2 and 3, respectively. The point of attachment is represented by fillets 15 and 16. Similarly, the ends 13 and 14 of arms 9 and 10 are secured to chopsticks 2 and 3, respectively. The points of attachment are represented by fillets 17 and 18. The points of attachments 15, 16, 17 and 18 are located upon corresponding chopsticks 2 and 3 such that the center of coils 5 and 6, representing the pivot point between the chopsticks, is located off center of the chopsticks and toward ends B and D. Thus, the exact points of attachment of coupling 4 to chopsticks 2 and 3 is essentially a function of the length of arms 7, 8, 9 and 10.

The two coil springs 5 and 6 may be simply laid atop one another and thence clamped together. Or, as shown in FIG. 2, the coil springs 5 and 6 may be entwined by passing arm 7 through the center of coil spring 6 and thence axially aligning the coil springs. The clamps 19 and 20 may be simply curved pieces of sheet metal which pieces are crimped to retain the coil springs adjacent one another. Other modifications, such as a pair of circular flanged plates disposed on either lateral side of the joined coil springs 5 and 6 and secured to one another by a weld or a nut and bolt, may be used. The ends 11 and 12 of arms 7 and 8 may be bent with respect to the remaining portion of the corresponding arms in order to insure a parallel relationship between the ends and the surface of the corresponding chopsticks. Such a parallel relationship will enhance the attachment and strength of the bond between the ends and the corresponding chopsticks. Similarly, ends 13 and 14 of arms 9 and 10 may also be bent with respect to the corresponding arms to render these ends parallel to the surface of the corresponding chopsticks.

The assembled coupling 4 is shown in FIG. 3. By inspection, it may be seen that arms 7 and 8 form an angle of greater magnitude than the angle formed by arms 9 and 10. With this arrangement, an imaginary line drawn adjacent ends 11 and 13 would intersect a second imaginary line drawn adjacent ends 12 and 14. These two imaginary lines, representative of chopsticks 2 and 3, respectively, indicate that the ends A and C of the chopsticks are biased further apart than ends B and D. The resulting configuration is then shown in FIG. 1.

For chopsticks made of material which would prevent a direct and physical attachment, as shown by fillets 15, 16, 17 and 18 in FIG. 1, the structure as shown in FIG. 4 may be employed. Each of arms 7, 8, 9 and 10 terminate in a coil (such as coils 21, 22, 23 and 24, respectively). These coils are dimensioned to frictionally engage the corresponding chopsticks. In example, coils 21 and 22 engage chopstick 2 and coils 23 and 24 engage chopstick 3. With this configuration, coupling 4 is readily usable with chopsticks made of ivory, wood, or other products not readily attachable to the metallic arms of the coupling.

Figure 6:
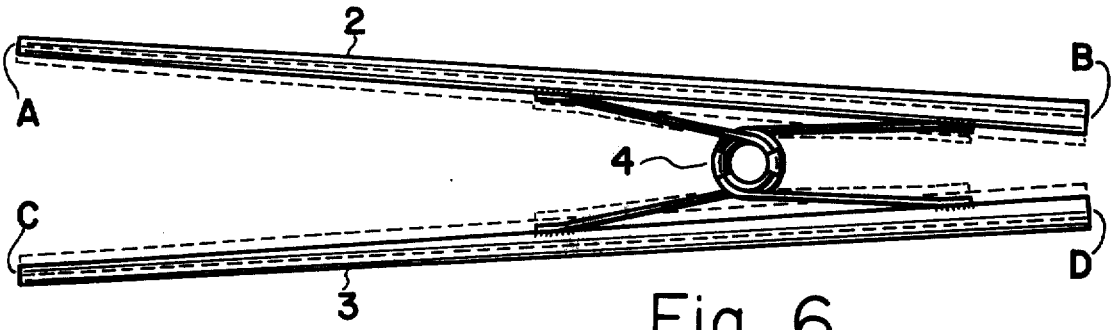
FIG. 6 illustrates the lateral movement of the present invention.

The operation of the present invention will be described primarily with reference to FIGS. 5 and 6. Chopstick 3 of the coupled pair of chopsticks 1 is grasped between the thumb and the second finger with ends A and C pointing away from the hand. The portion of chopstick 2 generally adjacent coil spring 4 rests upon the side of the hand adjacent the V formed between the base of the thumb and the hand. The forefinger rests upon the outer surface of chopstick 2 intermediate coupling 4 and end A. By depressing the forefinger, chopstick 2 tends to pivot about coupling 4 until end A contacts end C and restrains further pivotal movement. On release of pressure by the forefinger, chopsticks 2 and 3 will pivot in the reverse direction and ends A and C will spread apart. The dashed lines shown in FIG. 5 represent the positions of the elements of the set of coupled chopsticks 1 when ends A and C are in contact with one another. The solid lines represent the quiescent state of the set of coupled chopsticks 1. The coil springs clamped together and forming coupling 4 permits ready pivotal movement of the chopsticks about the axis of the coil springs but inhibit any other pivotal movement. Thus, the user may employ the present invention with ease by simply depressing his forefinger to grasp particles of food and releasing the pressure applied by his forefinger when the food is to be released. He need not be overly conscious about ends A and C being skewed when attempting to grasp the food as the coupling 4 prevents such skewing.

For those skilled in the use of chopsticks, small lateral movement of the chopstick in addition to pivotal movement is quite common. With the present invention, the flexibility and resilience of coupling 4 permits such lateral displacement, as shown by dotted lines in FIG. 6. It is therefore apparent that the present invention permits those unskilled in the art of eating with chopsticks to use them effectively and without frustration. Yet, the present invention doesn't detract from not inhibit the use of chopsticks in the nor of those skilled and proficient in their use.

Figure 7:
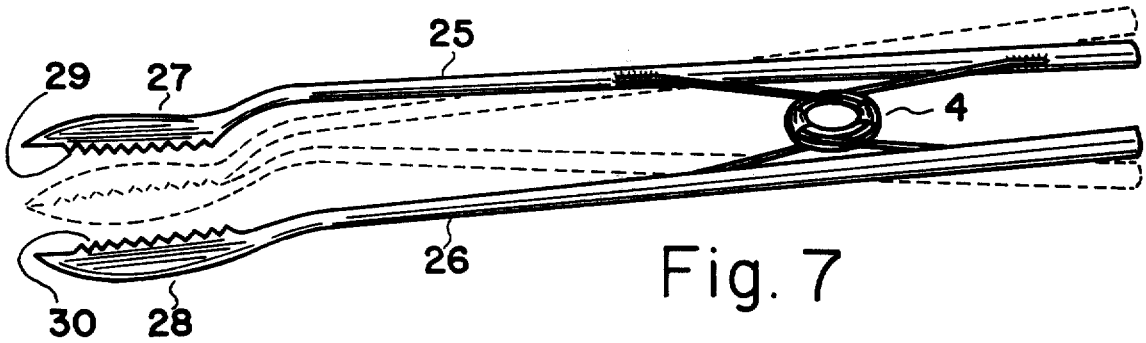
FIG. 7 illustrates another embodiment of the present invention.

Not only may coupling 4 be used with chopsticks to permit the eating of foods in accordance with the time honored Oriental custom, but it also suggests adaptation for use in connection with other eating implements. In FIG. 7 there is shown a pair of handles 25 and 26 connected to one another by means of coupling 4. The ends of handles 25 and 26 may include enlarged parts 27 and 28. Parts 27 and 28 have their interior edges serrated by serrations 29 and 30, respectively. When handles 25 and 26 are brought together as shown by the dotted lines in FIG. 7, parts 27 and 28 form a relatively wide surface. This surface may be used to convey food, or, if the parts 27 and 28 are dipped, the resulting cuplike surface may be used to ladle food. In addition, parts 27 and 28 may be used in the manner of a set of coupled chopsticks to grasp food. Parts 27 and 28 may be also used in the manner of a fork to spear food when serrations 29 and 30 are fine. Thus, with modifications of the ends of handles 25 and 26, a multipurpose eating utensil may be constructed in accordance with the teachings of the present invention.

While the principles of the invention have now been made clear in an illustrative embodiment, there will be immediately obvious to those skilled in the art many modifications of structure, arrangement, proportions, the elements, materials, and components used in the practice of the invention which are particularly adapted for specific environments and operating requirements without departing from those principles.

I claim:

1. A food handling utensil for grasping food particles, said utensil comprising in combination:

a. a pair of elongated member;

b. a flexible coupling disposed intermediate said members for maintaining said members in essentially the same plane;

c. said coupling including:

1. a first coil spring having a first pair of arms extending therefrom;

2. a second coil spring having a second pair of arms extending therefrom; and

3. means for attaching said first and second coil springs to one another in axial alignment disposing said arms like quatrefoil.

2. The combination as set forth in claim 1 wherein one arm of said first coil spring is secured to said one elongated member and the other arm of said first coil spring is secured to said other elongated member.

3. The combination as set forth in claim 2 wherein one arm of said second coil spring is secured to said one elongated member and the other arm of said second coil spring is secured to said other elongated member.

4. The combination as set forth in claim 3 wherein said pair of elongated members comprise a pair of chopsticks.

5. The combination as set forth in claim 3 including an enlarged section generally parallel to pivoting plane disposed one end of each of said members, said enlarged sections mating one another to form a common surface.

6. The combination as set forth in claim 5 wherein the mating edges of said enlarged sections are serrated.

7. The combination as set forth in claim 6 wherein each said enlarged section is dished, whereby said mated enlarged sections form a ladle.

8. The combination as set forth in claim 7 wherein the extremity of each said enlarged section is pointed; whereby, said separated enlarged sections form a fork.

9. The combination as set forth in claim 1 wherein the arms of said combination of said first and second coil springs are aligned on single plane.

* * * * *